US005533652A

United States Patent [19]

Levin

[11] Patent Number: 5,533,652

[45] Date of Patent: Jul. 9, 1996

[54] CAP BRIM SHAPING, TRANSPORT, STORAGE AND DISPLAY DEVICE

[75] Inventor: Gregg M. Levin, Boston, Mass.

[73] Assignee: Perfect Curve, Inc., Boston, Mass.

[21] Appl. No.: 345,475

[22] Filed: Nov. 28, 1994

[51] Int. Cl.[6] ..... D06C 15/00; A42C 1/00; A41F 1/00

[52] U.S. Cl. ..... 223/84; 223/25; 223/24; 24/459

[58] Field of Search ..... 223/84, 24, 25, 223/26, 22, 15, 17, 8, 12; 24/459

[56] References Cited

U.S. PATENT DOCUMENTS

| | | | |
|---|---|---|---|
| 2,779,987 | 2/1957 | Jordan | 24/459 |
| 3,737,081 | 6/1973 | James | 223/84 |
| 4,607,769 | 8/1986 | DeLisle et al. | 223/25 |
| 5,161,719 | 11/1992 | Ohenson et al. | 223/84 |
| 5,163,589 | 11/1992 | Biehl | 223/24 |
| 5,172,837 | 12/1992 | Finney, Jr. et al. | 223/84 |

FOREIGN PATENT DOCUMENTS

| | | | |
|---|---|---|---|
| 1559036 | 3/1969 | France | 24/459 |
| 1350571 | 4/1974 | United Kingdom | 24/459 |

*Primary Examiner*—C. D. Crowder
*Assistant Examiner*—Bibhu Mohanty
*Attorney, Agent, or Firm*—William Nitkin

[57] ABSTRACT

A device for bowing the brim of a cap and for storing, transporting and/or displaying such cap having a central body portion extending downward on each side and terminating with upwardly extending retention arms at each side thereof forming first and second receipt areas for receipt therein of the first side and second side of the cap brim, to form such brim into a desired curve with an elastic band extending over the top of the brim from the first retention arm to the second retention arm. Slots can be disposed inward of one of the receipt areas for receipt of one side of the brim to form alternate brim receipt areas for different desired brim curvatures.

7 Claims, 3 Drawing Sheets

CAP BRIM SHAPING, TRANSPORT, STORAGE AND DISPLAY DEVICE

BACKGROUND OF THE INVENTION

1. Field of the Invention

The device of this invention resides in the area of bowing devices for imparting a desired curve to a bendable structure and more particularly relates to a device into which the brim of a cap is positioned to bend the cap brim into a desired curved shape and which cap is retained in the device until the brim can maintain such curved shape on its own with such device also useful for transporting and storing the cap to maintain the brim in such desired curved shape.

2. Description of the Prior Art

Baseball caps are well known and generally have a fabric dome structure which fits over the head and a brim or visor extending from the front thereof which brim is made of a fabric covering stitched to a cardboard or plastic insert. When a baseball cap is purchased, the brim is a flat, planar member; and many purchasers will initially bend the brim manually to put a curve in it. Some individuals desire to have a more evenly curved brim than can be achieved by means of hand manipulation.

Most brim-bending methods of the prior art are not specifically adapted to put a neat, symmetrical curve in a baseball cap brim. In the prior art a curve is commonly accomplished by placing a somewhat rounded object, such as a baseball glove, under the brim and then curving the brim around the glove. Elastic bands are then placed around the brim and glove to have the brim form a desired even curve and be retained in that position until the brim takes on the desired curve on its own to maintain the brim in such curved shape. Other methods of curving a baseball cap brim are known such as using paper clips to clip the sides of the brim together. Another method requires that the brim be bent before turning the brim inside the cap and partially pulling it through the opening typically found in the rear of a baseball cap to hold the brim in such bent position until the brim retains a curve on its own. Formed wire devices in which caps can be washed are also known, which devices bend the brim and allow it to dry in such bent shape. Once a desired curve has been imparted to the brim, such curve is often difficult to maintain over time. For example, if one packs a cap having a curved brim in a suitcase, during travel pressure from the other contents in the suitcase against the curved brim may cause the brim to flatten out.

SUMMARY OF THE INVENTION

It is an object of this invention to provide a device which will impart a neat-appearing, consistent, symmetrical curve in a desired arc to the brim of a baseball-type cap for improved wearer comfort and overall cap appearance.

It is a further object of this invention to provide a device into which an already curved brim of a cap can be placed, stored and/or transported such as within a suitcase and the like which device will maintain the brim in such desired curved shape.

It is a still further object of this invention to provide a device having a selection of brim curved arcs from which to choose a desired curved shape. The device of this invention also can accommodate brims of various sizes and shapes to be symmetrically shaped in various curved arcs according to the wearer's preference.

It is a yet further object of this invention to provide an attractive display stand for use in the display and/or sale of baseball-type caps.

DESCRIPTION OF THE PREFERRED EMBODIMENT(S)

Figure 1:
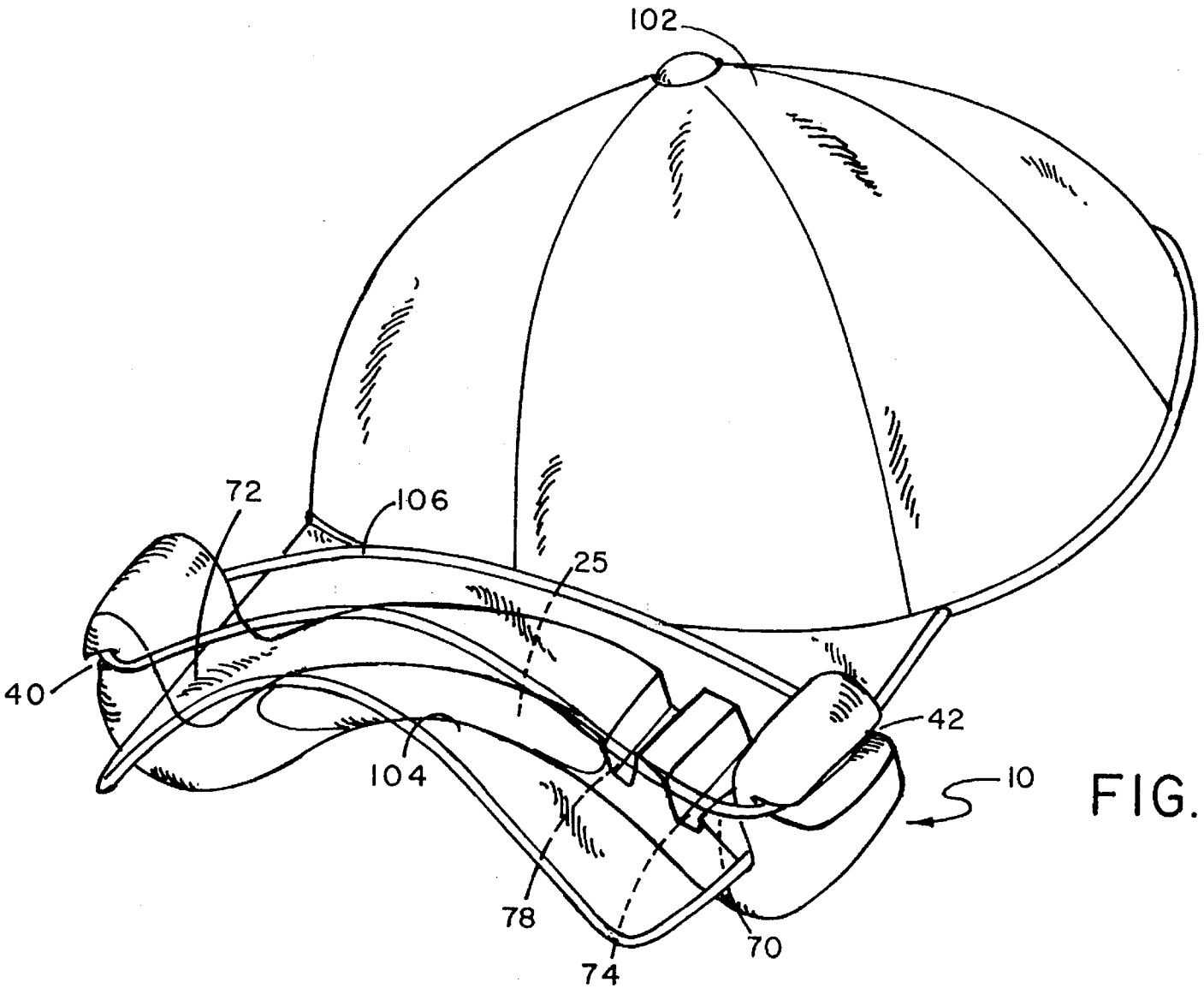
FIG. 1 illustrates a front perspective view of the cap brim shaping and storage device of this invention with a cap brim secured therein.
Figure 2:
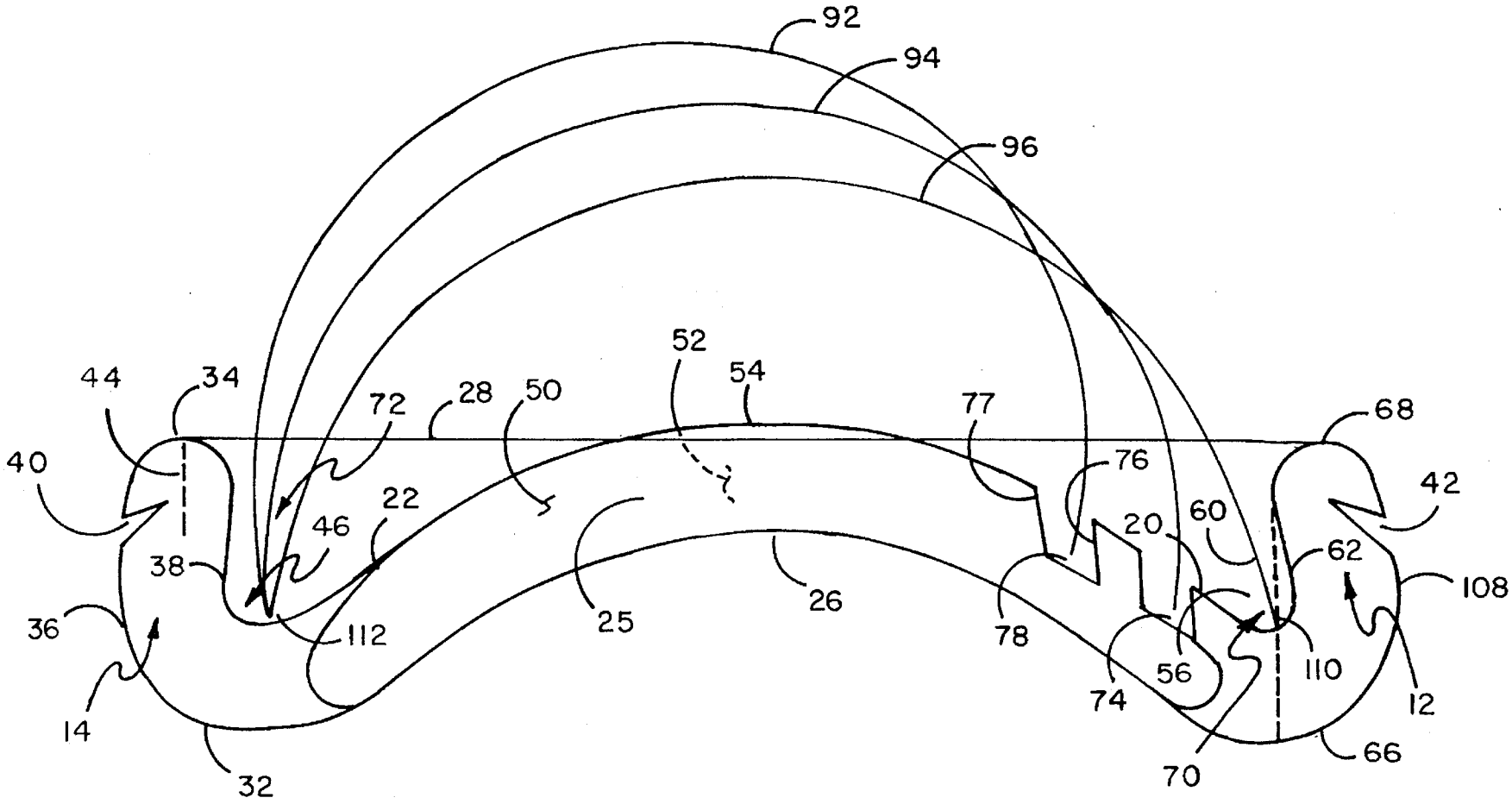
FIG. 2 illustrates a front view of the device of this invention.

FIG. 1 illustrates a front perspective view of the cap brim shaping and storage device 10 of this invention with a typical baseball cap 102 positioned in the device with its brim 104 held in place in the device by elastic band 106 which can be a rubber band or equivalent to exert downward pressure on the top of the brim to force the sides of the brim against first and second retention arms 12 and 14, seen in FIG. 2, causing the brim to bow in a curve.

FIG. 2 illustrates a front view of the device of this invention enlarged and without a cap brim positioned therein. Shown are the possible alternate selection of curved arcs of the brim available to the user by using the device of this invention such as first curved arc 92, second curved arc 94, and third curved arc 96. As seen in FIG. 2 the device in a preferred embodiment consists of a laterally disposed, unitary body having a top side, a bottom side, a front side, a rear side and an arched central portion 25 having first and second ends 66 and 32 and a crown 54 centrally disposed thereon having a height with central portion 25 having an upward arch 26 on its bottom side. The body of the device slopes downward, respectively, on each side of crown 54 to form, respectively, first and second shoulders 20 and 22. The device then curves sharply upwards at first and second ends 66 and 32 to form, respectively, first and second retention arms 12 and 14 having, respectively, first top 68 and second top 34 such that said first and second tops reach approximately to the height of crown 54. While second retention arm 14 extends straight upwards, first retention arm 12 extends both upwards and inwards toward crown 54. The body loosely resembles a stretched out letter "W". The distance between first and second retention arms 12 and 14 is generally less than the width of the brim to be curved. Second outer side 36 of the second retention arm 14 and first outer side 108 of the first retention arm 12 have formed, respectively, therein second notch 40 and first notch 42.

When the device is in use, as seen in FIG. 1, a rubber band or equivalent retention means is positioned, as described above, extending over the brim and exerting downward pressure on the top of the brim. The retention means are tensioned and stretched to engage first and second catch means such as first notch 42 and second notch 40. When the device is in use, as indicated by curved arcs 92, 94 and 96 in FIG. 2, second side 112 of brim 104 is snugly positioned in second valley 46 formed by the junction of inner side 38 of second retention arm 14 which extends upward approximately parallel to a line 44 drawn vertical to a line 28 drawn along the lateral axis of the body, forming second receipt area 72 before the body of the device extends up to form second retention arm 14. Second edge 112 of the brim rests and is caught within second receipt area 72 and cannot move laterally outward as it is stopped and caught by second retention arm 14 and by the downward pressure exerted by elastic band 106 on the top of the brim as seen in FIG. 1. First side 110 of brim 104 can fit in one of three selected alternate positions. The device, in its simplest form, only requires one first receipt area for it to function such as first receipt area 70 formed by the junction of first shoulder 20 and first inner side 62 where first retention arm 12 extends upwards from first shoulder 20. First side 110 of brim 104, indicated by third curved arc 96, is retained in position within first receipt area 70 by the positioning of first inner side 62 of first retention arm 12 which extends not only upwards but inwardly to be disposed at an acute angle to a line 60 drawn vertical to the lateral axis of the device to better catch and retain first side 110 of the cap. When the device is used with most adult-sized baseball caps, the first side of the brim would rest near the center of first receipt area 70, and be retained in position by an elastic band stretched over and contacting the top of the brim and extending from, and connecting, second notch 40 to first notch 42 formed, respectively, in second retention arm 14 and first retention arm 12. If one desired a more bowed curvature of the brim of if a smaller sized cap brim were to be curved, as illustrated by second curved arc 94, one would insert first side 110 of brim 104 into either first slot 74 or second slot 78 which are both disposed in shoulder 20 further inward from first retention arm 12. To help the brim fit into first slot 74 or second slot 78, the upwardly extending sides of each slot are disposed at an acute angle to a line drawn vertical thereto, such as first slot side 76 and second slot side 77 of second slot 78. Second slot 78 is disposed further inward from first slot 74 and is also of a width to receive the first side of the brim. Slot 78 disposes the first side of the brim therein at an even greater brim curvature, as indicated by first curved arc 92, than if the first side of the brim were disposed in first slot 74. In the above described manner the brim can be formed in one of a selected of three curved arcs from a device formed of a single unit.

Figure 3:
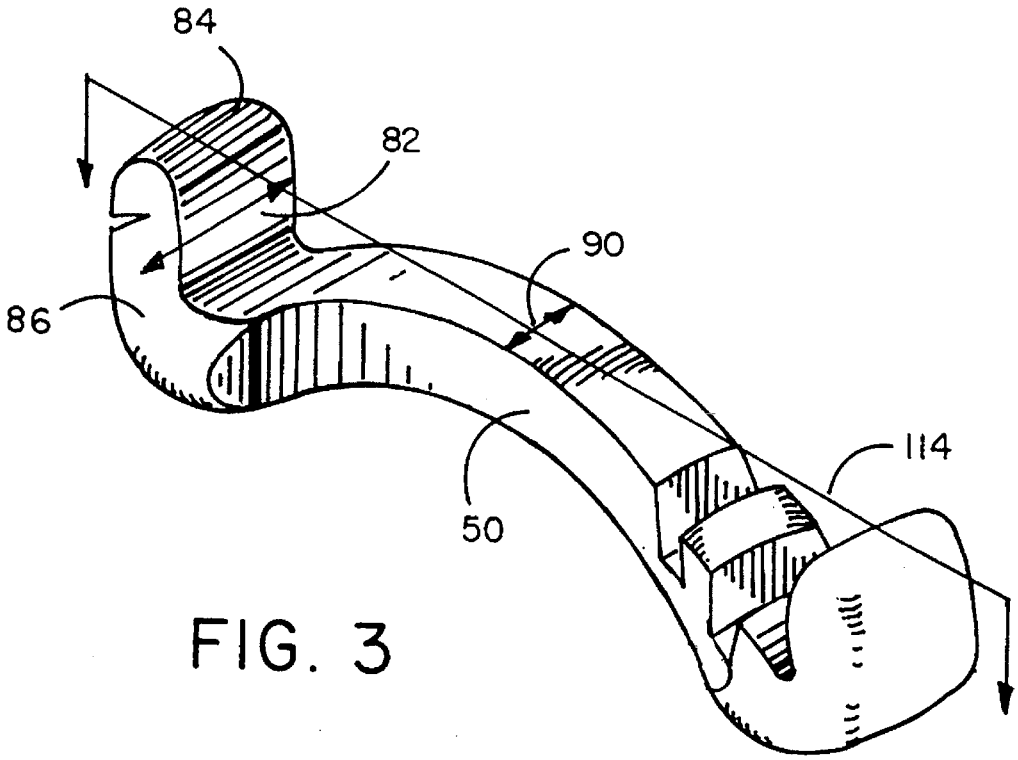
FIG. 3 illustrates a front perspective view of the device of this invention.
Figure 4:
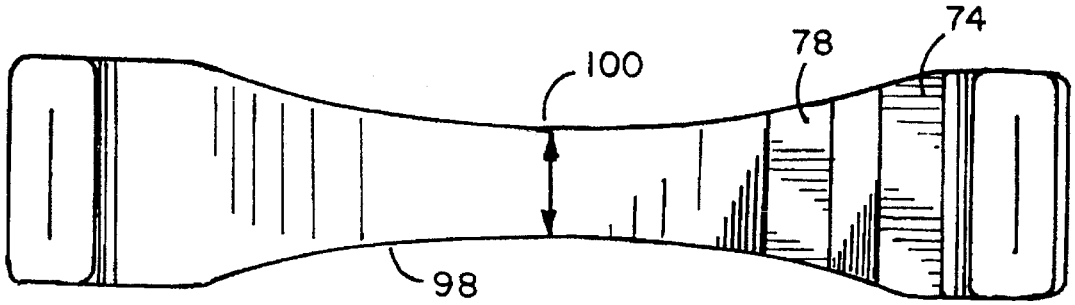
FIG. 4 illustrates a top view of the device of this invention.

As seen in FIGS. 2 and 3, the arched central portion of the body of the device can have a flattened front side 50 and a flattened rear side 52. As seen in FIGS. 3 and 4, the device can also be tapered inwardly on sides 50 and 52 to form narrow portion 90 being the thickness of the device at crown 54. As illustrated in FIG. 3, first and second retention arms 12 and 14 are elongated laterally and disposed in a perpendicular plane 82 to axis line 114 drawn along the length of the body of the device. In contrast to the thickness of narrow portion 90, the thickness of first and second retention arms 12 and 14 can be more than twice the thickness of the device at crown 54. Other lengths, widths and thicknesses of the device and its retention arms would still allow the device of this invention to function successfully. As also seen in FIG. 3 the retention arms can have rounded tops 84 as well as rounded sides 86 for easier storage and handling of the device and for a more pleasing appearance. By having the first and second retention arms have elongated thicknesses, the retention arms are better able to hold and retain the first and second sides of the brim of the cap within the device. The flattened front side 50 and flattened rear side 52 can be utilized as surfaces for the receipt of imprinting or placement of indicia such as advertising or brand or team names thereon. As seen in FIG. 4, flattened front and rear sides 50 and 52 can have a front inward curvature 98 and rear inward curvature 100 which curvatures do not affect one's ability to read any imprinting thereon. In a preferred embodiment the height of the central portion 25 and crown 54 thereof can rise to a point slightly higher than the height of the tops of first and second retention arms 12 and 14, and such feature helps to create a bowing device which is both strong and functional to provide desired curvature to the brim of a baseball cap.

The device not only can be used to form a desired curvature in the brim of a cap, but also can be used as a storage device when the cap is not in use by repositioning the cap therein in order to maintain the desired curvature such as when the cap is packed in a suitcase so that the brim will retain its curvature and not be inadvertently flattened by surrounding articles in the suitcase.

The device of this invention can also be used as a display stand such as for cap collectors or in the sale of baseball caps. The brim of a cap can be placed in a curved position as described above, with the front of the device providing an imprint receipt area along flattened front side 50 for any printed indicia or information such as store identification, advertising or pricing information forming the unitary whole.

The device of this invention in a preferred embodiment can be made of a unitary piece of plastic, metal, wood or any equivalent sturdy material or can be made of a plurality of component parts.

Although the present invention has been described with reference to particular embodiments, it will be apparent to those skilled in the art that variations and modifications can be substituted therefor without departing from the principles and spirit of the invention.

I claim:

1. A device for bowing the brim of a cap, said brim having a first side, a second side, a top and a width with the distance between said first side and said second side being the width of said brim, comprising:

a body having a laterally disposed central portion, said central portion having a first end, a second end, a top side, a bottom side, a front side, and a rear side, said central portion being arched upwardly, said top side having a crown portion centrally defined thereon, said bottom side forming an arch, said top side of said first end forming a first shoulder, said top side of said second end forming a second shoulder, said first end extending upwardly to form a first retention arm, said second end extending upwardly to form a second retention arm, said first and second retention arms each having a top, an inner side and an outer side;

a first receipt area defined at the junction at said first end of said central portion of said first shoulder and said first retention arm, and a second receipt area defined at the junction at said second end of said central portion of said second shoulder and said second retention arm, the distance between said first and second receipt areas being less than the width of said brim;

a first catch means disposed on said outer side of said first retention arm and a second catch means defined on said outer side of said second retention arm;

retention means connecting said first and second catch means from said first retention arm to said second retention arm; and said device in its use mode having said first and second sides of said brim positioned, respectively, in said first and second receipt areas of said device with said retention means extending over said brim exerting downward pressure on said top of said brim, forcing said first and second sides of said brim outward respectively against said first and second retention arms to force said brim into a bowed state.

2. The device of claim 1 further including:

a first slot defined in said top side of said first shoulder inward of said first first receipt area, said first slot to receive said first side of said brim, said device when in its use mode with said second side of said brim positioned in said second receipt area and said first side of said brim positioned in said first slot with said retention means extending over said brim exerting downward pressure on said first and second sides of said brim to force said brim into a more bowed state than when said first side of said brim is positioned in said first receipt area.

3. The device of claim 2 further including:

a second slot defined in said top side of said first shoulder further inward of said first slot, said second slot to receive said first side of said brim, said device in its use mode with said second side of said brim positioned in said second receipt area and said first side of said brim positioned in said second slot with said retention means extending over said brim, exerting downward pressure on said first and second sides of said brim to force said brim into a more bowed state than when said first side of said brim is positioned in said first slot.

4. The device of claim 3 wherein said first and second catch means are notches defined, respectively, in said outer sides of said first and second retention arms.

5. The device of claim 4 wherein said first and second retention arms each extends in a plane perpendicular to an axis line drawn laterally through said central portion of said body.

6. The device of claim 5 wherein said front side and said rear side of said central portion of said body are flattened to form an indicia receipt area.

7. The device of claim 6 wherein said first retention arm also extends inwardly to assist in catching said first side of said brim when the device is in use.

* * * * *